United States Patent [19]

Stenner

[11] Patent Number: 4,731,142

[45] Date of Patent: Mar. 15, 1988

[54] METHOD OF MAKING A PERSONALIZED FOLDER WITH POCKETS AND PAGE INSERTS FROM A CONTINUOUS WEB

[75] Inventor: John W. Stenner, Orange, Conn.

[73] Assignee: Kurt H. Volk, Inc., Milford, Conn.

[21] Appl. No.: 42,346

[22] Filed: Apr. 24, 1987

[51] Int. Cl.[4] ..... B31F 5/04

[52] U.S. Cl. ..... 156/226; 156/267; 156/277; 229/72; 229/73; 493/216; 493/222; 493/224

[58] Field of Search ..... 156/226, 267, 277; 229/72, 73, 92.1; 493/216, 222, 223, 224

[56] References Cited

U.S. PATENT DOCUMENTS

| | | | |
|---|---|---|---|
| Re. 25,961 | 2/1966 | Volks et al. | 493/216 X |
| 3,557,519 | 1/1971 | Lyon | 493/216 X |
| 4,067,171 | 1/1978 | Herbert et al. | 493/216 X |
| 4,080,236 | 3/1978 | Schulhof et al. | 156/226 X |
| 4,158,587 | 6/1979 | Keller et al. | 156/226 X |
| 4,161,091 | 7/1979 | Hartnig | 493/222 X |
| 4,437,852 | 3/1984 | Volk et al. | 229/73 X |
| 4,543,082 | 9/1985 | Stenner | 493/216 |
| 4,651,920 | 3/1987 | Stenner | 229/73 X |

*Primary Examiner*—Robert A. Dawson

*Attorney, Agent, or Firm*—Thomas E. Spath; Paul C. Hashim

[57] ABSTRACT

The subject invention provides a method of making a pocket folder having a plurality of page inserts from a pre-printed web. A first fold line is provided along a first transverse line which divides the web into integral folder and insert sections. A second fold line is provided along a second transverse line adjacent an end of the folder section opposite the insert section, thereby forming a folder pocket member. A third fold line formed along the longitudinal midline of the folder portion divides the folder portion into first and second cover sheets. The insert section is cut inside of and parallel to opposite longitudinal edges of the web to form lateral marginal portions. The insert portion is also cut adjacent to and parallel with the longitudinal center line to form a pair of insert pages separated by a medial marginal portion. The lateral and medial portions are removed and the insert pages are folded along the first transverse fold line to superpose the folder cover sheets. The folder pocket member is folded along the second transverse fold line into superpositon with the insert pages and the folder cover sheets to create folder pockets for the insert pages. The insert pages are then separted from the folder cover sheets to provide a pocket folder having removable page inserts. The folder as well as the page inserts may be personalized to the recipient to facilitate use of the packet folder in direct mailing campaigns.

13 Claims, 8 Drawing Figures

METHOD OF MAKING A PERSONALIZED FOLDER WITH POCKETS AND PAGE INSERTS FROM A CONTINUOUS WEB

BACKGROUND OF THE INVENTION

1. Field of the Invention

This invention relates to a method of making a personalized pocket-type folder containing at least one insert page from a continuous pre-printed web. The method is especially adapted for use with computer personalized web printed forms.

2. Description of the Related Art

In recent years computer directed printers have been utilized in connection with large volume mailings related to advertising or solicitation campaigns. In particular, the information contained in the computer's data input system which includes the normal addressee mailing information for printing the envelope has also been used in various forms to "personalize" the pre-printed advertising materials being transmitted. In its simplest and most common form, this personalization might constitute the inclusion of the addressee's name in a salutation line in what otherwise would be recognized as a form letter. The intended effect of such personalized advertising messages is, of course, to capture and maintain the attention of the addressee for the purpose of having him read all the information transmitted. These personalization techniques have resulted in increased returns to the advertiser thereby enhancing their value as a selling or solicitation medium.

In addition, the computer directed printing devices have been used in conjunction with continuous high speed web printing equipment to produce advertising materials that include not only personalized salutations, but also the repetition of the addressee's name and other related personal information in various locations throughout the advertising material. Up to the present the formats for such personalized mass-produced mail advertising materials have been limited by economic considerations to letters or simple brochures.

Another useful format for advertising materials is the pocket folder. These folders generally include a number of insert pages which are typically assembled by hand in a desired sequence and inserted into the pocket or pockets of the presentation folder. The insert pages may be color coded or sequentially dimensioned to provide for further categorization. Due to the degree of manual-intensive labor required to assemble the folders, the use of the pocket folder as a vehicle for large volume direct mail advertising has not been fully appreciated. The reason for this lies largely with the manner in which the folders have heretofore had to be prepared. Because folder preparation is so labor intensive, production of folders on a large scale is quite expensive. Additionally, the opportunity for error in assembly is great. Incorrect folder assembly presents a serious problem because defective folders are difficult to detect prior to delivery to the recipient. When a defective brochure is delivered, its advertising impact is greatly diminished because the recipient, upon discovery of the error, is likely to lose interest in the remainder of the disclosure material. For these reasons, multi-insert pocket folders have not been widely utilized as the direct mass mail advertising medium.

Accordingly, it is an object of the invention to provide a method of making a pocket folder having a plurality of inserts that may be accurately and inexpensively produced.

Another object of the invention is to provide a method of making a pocket folder having a plurality of inserts that is compatible with largely automated direct mail advertising campaigns.

Still another object of the invention is to provide a method of making a pocket folder having a plurality of inserts in which the folder and the inserts are formed from a continuous web.

These and other objects and advantages of the subject invention will become apparent from the detailed description below.

SUMMARY OF THE INVENTION

The invention relates to pocket folders having at least one insert page contained within the folder pocket. In a preferred embodiment, the folder has front and rear covers with a pocket formed along the inside face of each cover. At least one separate page is inserted in each of the pockets. The insert pages, along with the folder covers, are preferably formed from a continuous, pre-printed web. Additional printed personalized information directed to a particular recipient may be provided on selected insert pages and along a portion of at least one of the covers.

In the preferred method of manufacture, a pocket folder having a plurality of inserts is formed from a pre-printed web. The steps of manufacture include forming a first fold line in the web along a first transverse line, thereby dividing the web into integral folder and insert sections, forming a second fold line in the folder section along a second transverse line adjacent an end of the folder section opposite the insert section, thereby forming a folder pocket member, and forming a fold line in the folder along the longitudinal center line thereof to provide first and second folder cover sheets. The insert section is cut inside of and parallel to the opposite longitudinal edges of the web to form lateral marginal portions. Individual insert pages are formed by cutting the insert section adjacent to and parallel with its longitudinal center line, thereby creating a medial marginal portion. The lateral and medial marginal portions are then removed from the web. The first and second insert pages are folded into superposition with the first and second folder cover sheets. Lines of adhesive are applied along the lower external edges of the cover sheets, and optionally along the lower portion of the longitudinal center line, to secure the pocket member and form pockets along the bottom of the inside of the cover sheets. The folder pocket member is then folded toward the first and second folder cover sheets along the second transverse fold line and into contact with the lines of adhesive to form the pockets.

Thereafter, the first and second insert pages and the attached first and second folder cover sheets are cut adjacent the first transverse line to sever the connection between the insert pages and the folder cover sheets. The finished pocket folder is obtained by folding one cover sheet toward the other along the longitudinal center line.

In a preferred aspect of the method of the invention, at least one of the lines is a perforated fold line. Preferably, the folder pocket member is adhesively secured to the folder cover sheets.

Another preferred aspect of the method of the invention provides that at least a portion of one of the folder cover sheets is pre-printed with personalized information.

In another preferred aspect of the method of the invention, a second web of insert pages is superposed over the web comprising the folder cover sheets prior to folding to produce a pocket folder having a plurality of page inserts in each pocket.

BRIEF DESCRIPTION OF THE DRAWINGS

Further objects and advantages of the present invention will become apparent to those skilled in the art from the following detailed description taken in conjunction with the drawings, in which.

DETAILED DESCRIPTION OF THE PREFERRED EMBODIMENT

Figure 1:
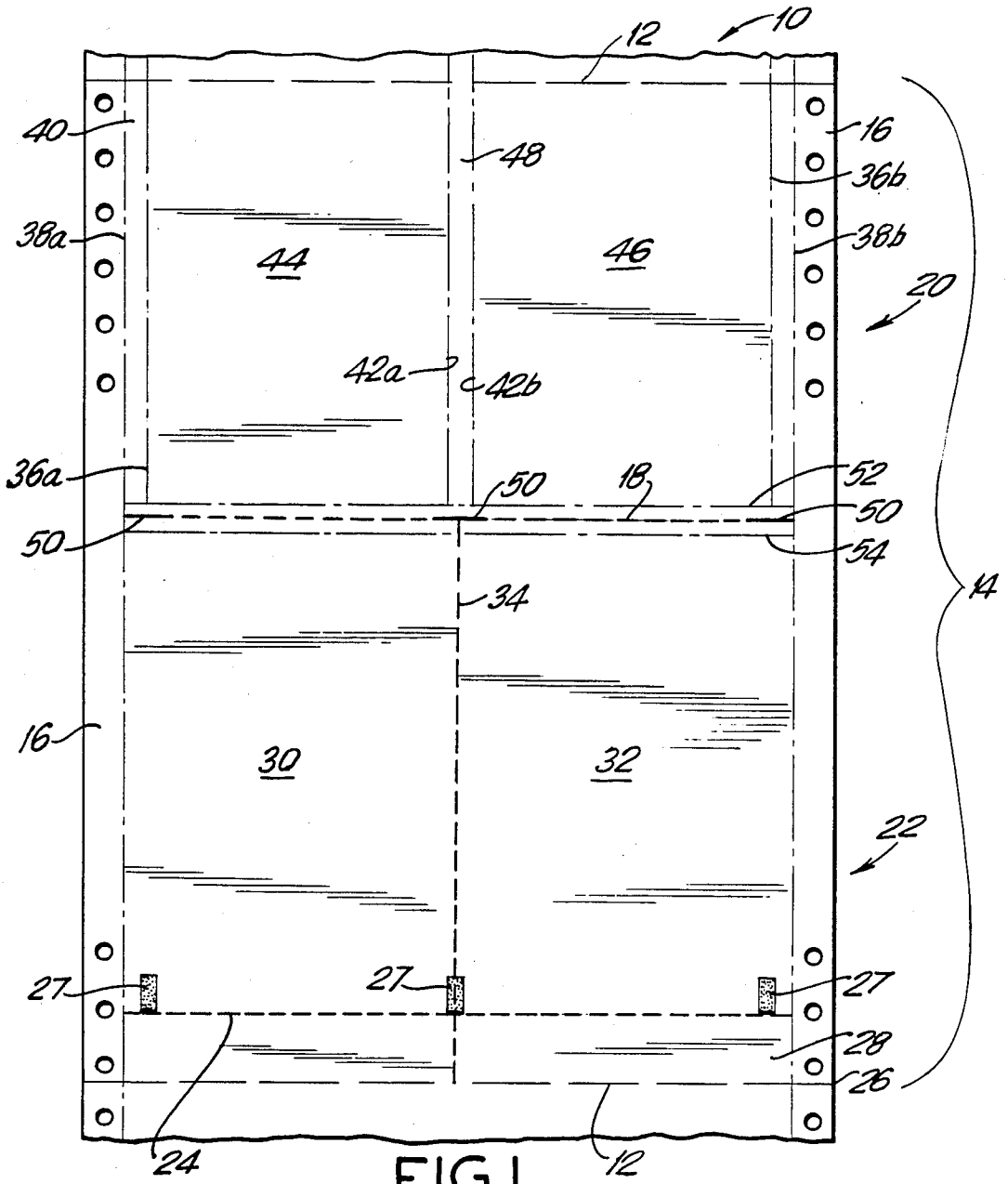
FIG. 1 is a plan view showing a section of continuous paper web prior to folder assembly, in which a portion of the web is divided into composite insert and folder portions.

Referring to the drawings in detail, wherein like reference numerals designate corresponding parts throughout the several views, and particularly to FIG. 1, there is shown web 10 which is divided by transverse separation lines 12 into repeating composite sheets 14.

Web 10 is a continuous web preferably formed from paper provided with parallel line hole edge strips 16 for engagement with feed wheels of web feeding equipment. The web 10 can be form printed and personalized in line with conventional printing press equipment and then personalized by a computer directed printer such as a laser printer. This arrangement permits high speed feeding and proper indexing for personalization of members to be formed from the web. Additionally, the arrangement of line hole edge strips 16 facilitates bursting operations, as described in detail below.

Figure 4:
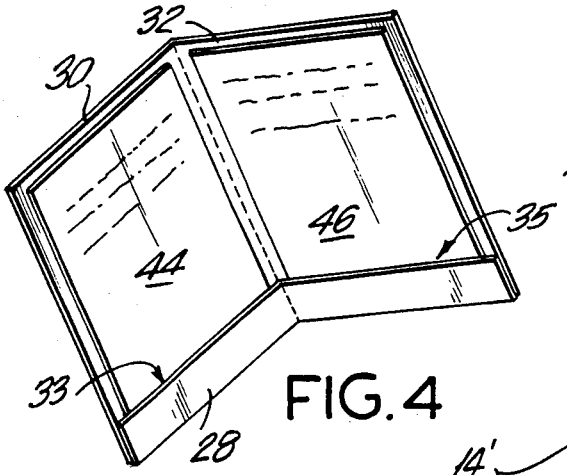
FIG. 4 is a perspective view of a completed pocket folder formed according to FIGS. 1–3 having a page insert inserted in each pocket.

Composite sheet 14 is provided with a first transverse fold line 18 which extends across the sheet 14 and divides the sheet into an insert section 20 and a folder section 22. First fold line 18 is provided to facilitate folding of the composite sheet 14 in the manner set forth below, and can be perforated or scored. A second fold line 24, which can also be perforated or scored, extends generally transversely across folder portion 22 adjacent an end 26 thereof opposite the first fold line 18 to provide a folder pocket member 28. Front and near folder cover sheets 30, 32 are formed from folder section 22 by a third fold line 34 extending generally along the longitudinal center line of web 10. As shown in FIG. 4, folder pocket member 28 cooperates with cover sheets 30, 32 in the manner set forth below to define pockets 33 and 35 respectively, for receiving pre-printed page inserts 44, 46. Lines of adhesive 27, such as hot melt or remoistenable adhesive, are provided along the lower external edges of cover sheets 30 and 32 to secure pocket member 28 and form the pockets at the bottom of the inside of the covers. One or more lines of adhesive can also be applied along or adjacent to the lower portion of the longitudinal center line to further secure the pocket member 28 to the cover sheets 30 and 32.

A first pair of laterally spaced, generally parallel cutting lines **36*a*, 36*b* extend parallel to the longitudinal axis of the web 10 adjacent the outer edges 38*a*, 38*b*, respectively, of insert section 20. Between each of cutting lines 36*a*, 36*b* and line hole edge strips 16 is a lateral marginal portion 40** that is later removed during bursting.

A second pair of laterally spaced, generally parallel cutting lines **42*a*, 42*b* is provided adjacent to and parallel with the longitudinal midline of the web. Cutting lines 42*a* and 42*b*, along with cutting lines 36*a* and 36*b*, divide insert portion 20 into first 44 and second 46 insert pages. Medial marginal portion 48 formed between cutting lines 42*a* and 42*b* is later removed during bursting. Slits 50 formed along first perforation fold line 18 adjacent lateral and medial marginal portions 40 and 48 are provided to facilitate removal of the marginal portions during folder assembly. Cutting lines 52 and 54 extending along opposite sides of perforation line 18 provide for separation of insert pages 44 and 46 from cover sheets 30, 32 during folder assembly. The cutting lines 52, 54 are superposed over one another when the sheet 14 is folded along fold line 18** and transversely cut to separate the insert pages from the cover pages, as set forth in detail below.

Figure 7:
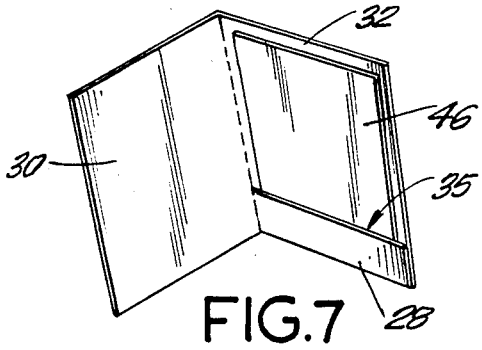
FIG. 7 is a perspective view of a single pocket folder.

While a two-pocket folder has been described in the foregoing description, it is also possible to provide a single pocket folder or a folder having three or more covers (i.e., front, center, and back). A single pocket folder, such as that shown in FIG. 7, is obtained by trimming away a portion of the pocket member 28 extending from one of the cover sheets and the corresponding insert page prior to folding. As shown in the figure, the portion of pocket member 28 extending from cover sheet 30 has been removed prior to folder assembly to provide the pocket on the inside of the back cover 32. However, it can be appreciated that the pocket may instead be provided on the inside of the front cover 30 by trimming the portion of the pocket member 28 adjacent the back cover 32 and corresponding insert page 46 prior to folder assembly. This trimming can be accomplished by scissor cutters or other suitable cutting implements.

Figure 8:
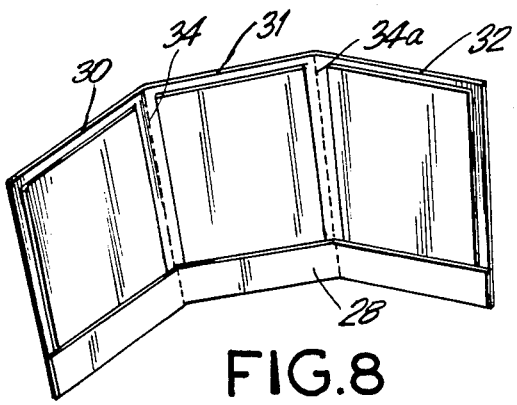
FIG. 8 is a perspective view of a three pocket folder.

A folder having three or more covers, such as the three cover folder depicted in FIG. 8, can be formed in the manner described above in connection with the two pocket folder shown in FIGS. 1–4, with the exception that a second longitudinal fold line **34*a* would also be added. Longitudinal fold lines 34 and 34*a* would be laterally spaced along the web to divide the web into three side-by-side cover sheets 30, 31 and 32. The cover sheets 30–32 may be of substantially equal width, as shown, or may be of differing widths. For example, the cover sheets may be arranged so that the center sheet 31 is approximately twice as wide as cover sheets 30 and 32 so that a part of center sheet 31 is covered by each of sheets 30 and 32**. Pockets may be provided for one or more of the cover sheets, in the manner described above.

The article of the subject invention is particularly useful in direct mail sales presentations where the initial impression created by the sales literature is of special importance. For example, insert pages 44 and 46 may be printed in different colors or in different print to focus the reader's attention on particularly significant portions of the sales literature. Such attention-focusing devices, when used in conjunction with the folder format of the sales literature, convey a degree of seriousness and professionalism on behalf of the sender that is not matched by conventional mass mail media such as form letters. Accordingly, the sales literature enclosed within the folder pockets 33 and 35 has a greater chance of being more carefully read by the recipient, thereby increasing the likelihood of a favorable consumer response.

In the method of the invention, blank web 10 is fed into a form printer, such as a flexigraphic, lithographic, gravure, or letter press. Each of these presses is capable of printing, for example, form messages appropriately positioned to be within the borders of the insert pages 44 and 46. Additionally, the form printer may print a form message along a desired portion of the folder cover sheets 30 and 32. Coloring and other indicia may also be added at this stage of folder preparation.

With reference to FIG. 1, die cutting operations can be performed on the form printer. For example, slits 50 and cutting lines 36*a*, 36*b* and 42*a*, 42*b* can be die cut to facilitate removal of the lateral and medial margin portions 40 and 48 during bursting. In addition, transverse separation lines 12 may be die cut to separate the web 10 into repeating composite sheets 14.

Following its exit from the form printer, web 10 is next indexed and fed into a computer directed printer such as a high speed laser printer for personalization. Personalization permits information such as the recipient's name, address or customer account number to be inserted on the printed form material, as well as on the folder cover sheets, thereby increasing the likelihood that the recipient will review the enclosed material.

Web 10 is next subject to line hole slitting and removal. Specifically, line hole strips 15 along with lateral and medial margin portions 40 and 48 are "burst" and removed by appropriately positioned line hole slitting and removal equipment. Transverse separation lines 12, which define individual composite sheets 13, are preferably formed by perforating wheels (not shown).

Figure 2:
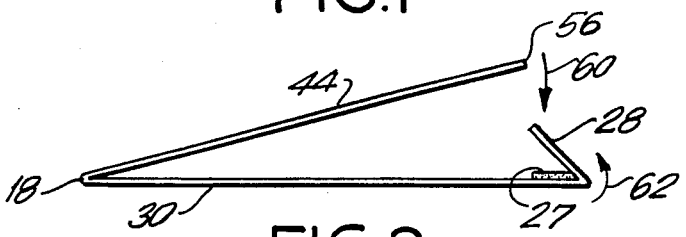
FIG. 2 is a schematic side view illustrating folding of the insert and folder portions of FIG. 1 after die cutting and bursting from the continuous paper web.
Figure 3:
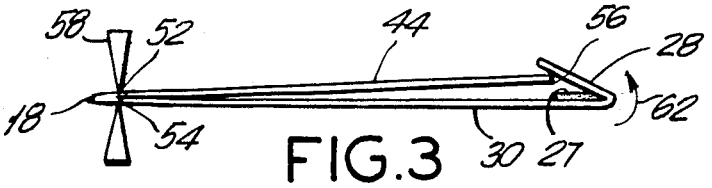
FIG. 3 is a schematic side view depicting cutting of the insert pages from the folder portion of the embodiment depicted in FIG. 2.

Perforations are also provided along folding lines 18 and 24 to facilitate folding of the web 10 in the manner depicted in FIGS. 2 and 3. In addition, perforation or scoring may be provided along longitudinal fold line 34. Following bursting, the individual composite sheets 14 are separately fed into a conventional multiplate folding machine.

Following folding along line 18, but preferably prior to folding along line 24, beads of adhesive 27 are applied inwardly of each opposite lower lateral edge of cover sheets 30 and 32 adjacent pocket member 28 and fold line 24. Adhesive 27 may also be applied along or adjacent to the lower portion of fold line 24 adjacent pocket member 28.

Following application of the adhesive, insert pages 44 and 46 are folded in the direction of arrow 60 along fold line 18 to superpose cover sheets 30 and 32, respectively, as shown in FIGS. 2 and 3. Thereafter, pocket member 28 is folded along fold line 24 in the direction of arrow 62 to overlie the lower, free end 56 of insert pages 44 and 46 and underlying cover sheets 30 and 32. Adhesive 27 retains pocket member 28 in the desired, overlying position. As shown in FIG. 4, pocket member 28 cooperates with cover sheets 30 and 32 to provide folder pockets 33, 35 in the respective cover sheets. After insert pages 44 and 46 and pocket member 28 have been folded as set forth above, the insert pages are separated from, folder cover sheets 30 and 32 to provide removable insert pages within pockets 33 and 35. This separation is accomplished by trimming the insert pages adjacent fold line 18 along superposed cutting lines 52 and 54. Trimming can be accomplished by a slitting device comprising scissor wheels 58, or other suitable cutting devices.

As a result of the final separation or trimming of the insert pages and folding along fold line 34, a pocket folder is provided which is suitable for use in direct mail marketing campaigns. The folder as well as its insert pages may be personalized for each intended recipient to increase the likelihood of a favorable consumer response.

While the foregoing detailed description discloses a method for preparing a pocket folder having two printed insert pages, one in each folder pocket, the method can readily be adapted to provide a pocket folder having a greater number of printed insert pages in each folder pocket. Preparation of such a multi-page pocket folder is depicted in FIG. 5.

Figure 6:
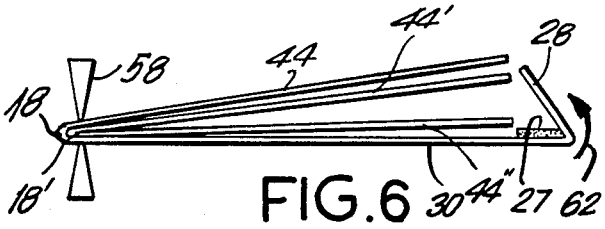
FIG. 6 is a schematic side view depicting cutting of the insert pages from the folder portion of the embodiment depicted in FIG. 5.
Figure 5:
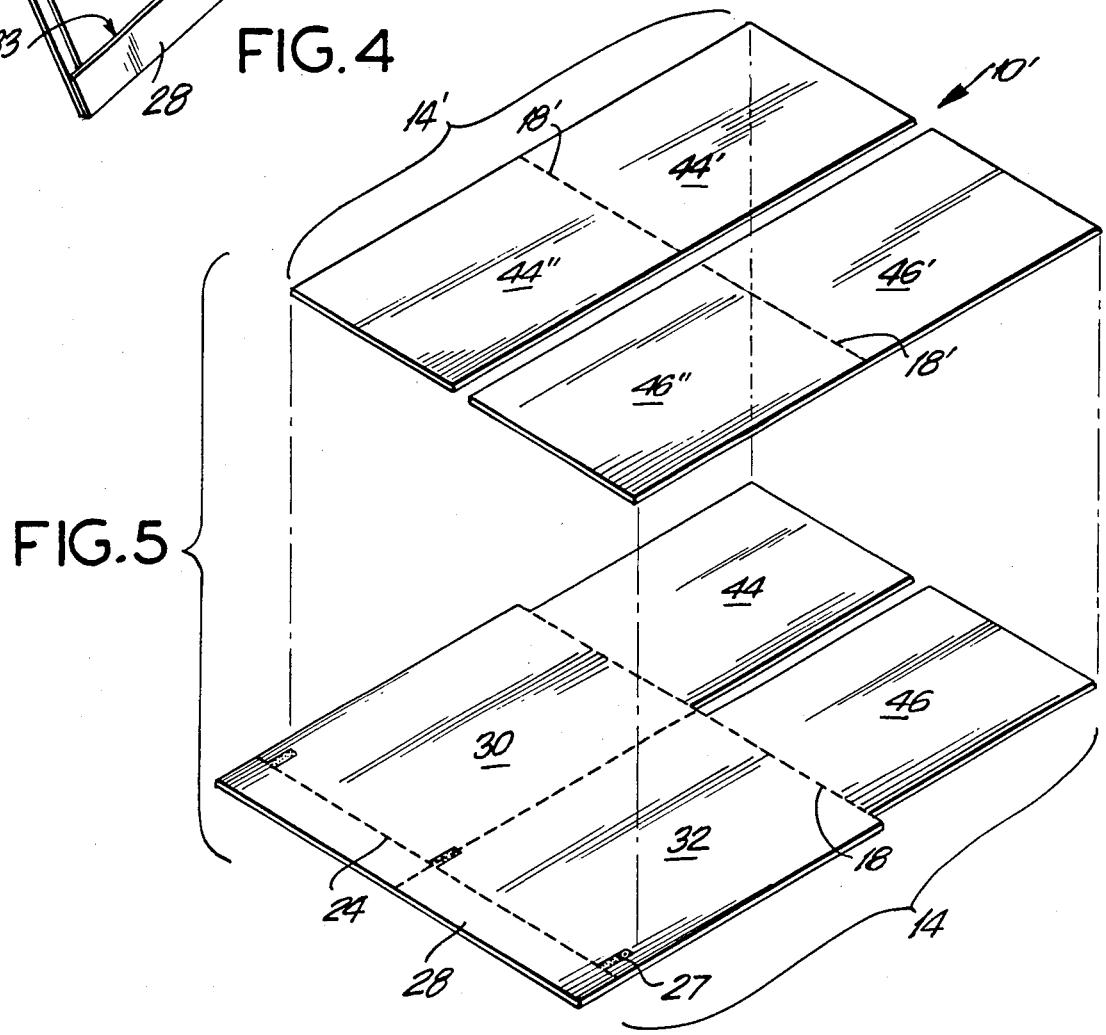
FIG. 5 is an exploded perspective view illustrating the alignment for mating of a second web of insert pages with the folder and insert page web of FIG. 1.

With reference to FIG. 5, there is shown a web 10' comprising a composite sheet 14' of paired insert pages 44', 46', 44'' and 46'' overlying composite sheet 14, which comprises insert pages 44 and 46 and folder cover sheets 30 and 32. It can therefore be appreciated that composite sheet 14' is similar to composite sheet 14, with the exception that the lateral and medial margins 36*a*, 36*b* and 48 of sheet 14 extend the entire length of sheet 14'. Composite sheets 14 and 14', as depicted in the figure, have previously had their respective line hole edge strips and lateral and medial marginal portions removed in the manner set forth above. In addition, the portion of the composite sheet 14' corresponding to pocket member 28 of sheet 14 has been removed, preferably prior to superposition. Insert pages 44' and 44'' are connected to one another along fold line 18, Similarly, insert pages 46' and 46'' are connected to one another along fold line 18'. When the folder is to be formed in the manner described above and shown in FIGS. 2–4, composite sheet 14' is superposed over composite sheet 14 so that insert pages 44' and 46' overlap insert pages 44 and 46, respectively, and insert pages 44'' and 46'' overlap folder cover sheets 30 and 32, respectively. Fold line 18' is superposed over fold line 18. Therefore, when insert pages 44 and 46 are folded along fold line 18 toward superposed alignment with cover sheets 30 and 32, respectively, as shown in FIG. 6, insert pages 44' and 46' are folded along fold line 18, toward superposition with pages 44'' and 46'', which in turn are moved into superposition with cover sheets 30 and 32. Folding of pocket member 28 toward cover sheets 30 and 32 creates folder pockets 33 and 35 as described above. However, instead of containing only a single insert page, as is the case with the pocket folder described in FIGS. 2–4, each pocket contains three individual insert pages following final page insert separation. It will be appreciated that additional insert pages can be provided by superposing additional sheets of insert pages over composite sheet 14 prior to folding.

As will be appreciated by persons skilled in the art adaptations of formats and uses for the articles and methods described above can be made which fall within the scope of the invention and the appended claims.

What is claimed is:

1. A method for producing an article suitable for mailing, that comprises a folder having a front cover and a back cover, a pocket in at least one of the covers, and a printed sheet insertable in the pocket, the article being produced from a composite sheet comprising:

(i) a folder section defining a front cover and a back cover joined together along a longitudinal line;

(ii) an insert section joined to said folder section along a first transverse line;

(iii) a pocket member joined to said front and back covers along a second transverse line;

the method comprising the steps of:

(a) trimming said insert section to a width less than the adjoining folder section;

(b) folding said trimmed insert section along said first transverse line to a superposed position over at least one of said front and back covers;

(c) folding said pocket member toward said insert section and said superposed cover;

(d) separating said insert section from said folder section; and (e) folding along said longitudinal line to superpose said covers.

2. The method of claim 1, wherein said pocket member is secured to at least one of the front and back covers.

3. The method of claim 1, further comprising the step of trimming said insert section along parallel lines outwardly displaced from the longitudinal center line of the insert section to define insert pages and folding said insert pages toward said folder section along said first transverse line.

4. The method of claim 1, further comprising the step of trimming a portion of said pocket member prior to folding along said second transverse line so that a pocket is formed along only one of said covers.

5. The method of claim 4, wherein lateral edges of said folder pocket member are adhesively secured to a lower portion of the cover along which said pocket is to be formed.

6. The method of claim 1, further comprising the step of personalizing a portion of at least one of said covers.

7. The method of claim 1, further comprising the step of superposing over the first insert section prior to said trimming steps a second insert section, each of said insert sections following trimming, being dimensioned to fit within a pocket formed by said pocket member.

8. The method of claim 1, in which at least one of said fold lines is a perforated fold line.

9. The method of claim 1, further comprising the step of printing at least a portion of said folder section.

10. The method of claim 9, wherein said step of printing comprises personalization.

11. The method of claim 1, wherein said step of separating said insert section from said folder section is accomplished by cutting.

12. The method of claim 11, wherein said cutting is performed by a scissor cutter.

13. The method of claim 11, wherein said cutting is performed by a wheel cutter.

* * * * *